US007660555B2

(12) United States Patent
Morita

(10) Patent No.: US 7,660,555 B2
(45) Date of Patent: Feb. 9, 2010

(54) PRINTING APPARATUS, INFORMATION PROCESSING APPARATUS, AND CONTROL METHOD THEREFOR

(75) Inventor: Naoki Morita, Kanagawa-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 400 days.

(21) Appl. No.: 11/148,242

(22) Filed: Jun. 9, 2005

(65) Prior Publication Data

US 2005/0276641 A1 Dec. 15, 2005

(30) Foreign Application Priority Data

Jun. 14, 2004 (JP) ..... 2004-175996

(51) Int. Cl.
*G03G 15/00* (2006.01)

(52) U.S. Cl. ..... 399/382; 399/397

(58) Field of Classification Search ..... 399/382, 399/381, 397
See application file for complete search history.

(56) References Cited

U.S. PATENT DOCUMENTS 5,442,732 A * 8/1995 Matysek et al. ..... 358/1.17
5,481,353 A * 1/1996 Hicks et al. ..... 399/382
5,749,024 A * 5/1998 Young ..... 399/85
6,765,685 B1 * 7/2004 Yu ..... 358/1.13
7,027,170 B1 * 4/2006 Nishikawa et al. ..... 358/1.15

FOREIGN PATENT DOCUMENTS

JP 11084948 3/1999
JP 2000147943 5/2000
JP 2000-185445 7/2000

OTHER PUBLICATIONS

Japanese Office Action dated Oct. 26, 2009 for Counterpart Application No. 2004-175996.

* cited by examiner

*Primary Examiner*—Anthony H. Nguyen
(74) *Attorney, Agent, or Firm*—Fitzpatrick, Cella, Harper & Scinto

(57) ABSTRACT

When no blank page is to be printed (S407) and an interleave page is to be output before or after a page to be printed (S405), if both a page to be printed and an interleave page to be output following the page to be output are blank pages (S406, S408), the page to be output and the interleave page are not printed out (S409).

2 Claims, 5 Drawing Sheets

PRINTING APPARATUS, INFORMATION PROCESSING APPARATUS, AND CONTROL METHOD THEREFOR

FIELD OF THE INVENTION

The present invention relates to a technique associated with printing.

BACKGROUND OF THE INVENTION

Conventionally, in a system comprising an information processing apparatus such as a personal computer and a printer, a print control method called a "blank page skip", in which if there is a blank page in print data, the blank page is not printed, has been used.

On the other hand, a printing control method having a so-called "interleave paper insertion function" has been available, which performs printing on media which should not be output upon being directly stacked on each other, e.g., OHP films, while inserting interleave paper between the media to prevent them from being directly stacked on each other and also prevent ink from being transferred onto a layout sheet or the back side of a sheet. In addition, in some cases, printing is performed on such interleave paper.

Conventionally, when two print control operations, i.e., "blank page skip" and "interleave paper insertion", are performed at the same time, print control is generally performed to nullify the setting for blank page skip to inhibit blank page skip so as to prevent blank page skip from being performed for interleave paper (see, for example, Japanese Patent Laid-Open No. 2000-185445).

In this method, however, if both a page to be printed and the subsequent interleave paper are blank, blank sheets are continuously output, resulting in wasteful output of sheets.

Assume that interleave paper sheets are not blank pages (when printing is performed on the interleave paper sheets), and the contents printed on all the interleave paper sheets are the same. In this case, if an output page is a blank page, the page output as a blank page and the subsequent interleave paper become wasteful outputs. However, since the setting for blank page skip has been nullified, wasteful paper outputs occur.

There has been available a conventional printer apparatus which allows ON/OFF setting for "blank page skip" as a function of the printer alone through the operation unit of the printer body.

In addition, there has been available a printer driver for an information processing apparatus, which allows setting for the execution/nonexecution of "interleave paper insertion". When setting for the execution of "interleave paper insertion" is to be made, the driver also allows setting for "also printing on interleave paper".

Note that the setting for "also printing on interleave paper" is a mode of printing the same contents as those printed on a page to be printed on the interleave paper before or after the page to be printed.

This printer apparatus is not linked with the settings for "blank page skip" which are made by the printer driver of the information processing apparatus. Therefore, there has been a combination of a printer apparatus and a printer driver, which is designed such that when there is no print data on a page to be printed, no printing is performed on a blank page without fail, and when there is print data on a page to be printed, the page is printed, regardless of settings for "interleave page insertion" and "also printing on interleave paper" which are set from the printer driver.

SUMMARY OF THE INVENTION

The present invention has been made in consideration of the above problem, and has as its object to provide a technique of performing blank page skip even if pages to be printed and interleave paper sheets are to be alternately output.

In order to achieve an object of the present invention, for example, a printing apparatus of the present invention comprises the following arrangement.

That is, a printing apparatus comprising:

first holding means for holding first setting data indicating whether or not to print a blank page;

second holding means for holding second setting data indicating whether or not to output an interleave page; and printing means for printing out a page to be printed and an interleave page in accordance with the setting data held by the first holding means and second holding means, wherein when a setting made by the first setting data indicates inhibition of printing of a blank page and a setting made by the second setting data indicates that an interleave page is to be output, if both a page to be printed and an interleave page to be output before or after the page to be printed are blank pages, the printing means do not print out the page to be printed and the interleave page.

In order to achieve an object of the present invention, for example, an information processing apparatus of the present invention comprises the following arrangement.

That is, an information processing apparatus comprising:

first holding means for holding first setting data indicating whether or not to print a blank page;

second holding means for holding second setting data indicating whether or not to output an interleave page; and control means for outputting a page to be printed and an interleave page to a printing apparatus in accordance with the setting data held by the first holding means and second holding means, wherein when a setting made by the first setting data indicates inhibition of printing of a blank page and a setting made by the second setting data indicates that an interleave page is to be output, if both a page to be printed and an interleave page to be output before or after the page to be printed are blank pages, the control means do not output the page to be printed and the interleave page to the printing apparatus.

In order to achieve an object of the present invention, for example, a control method for a printing apparatus of the present invention comprises the following arrangement.

That is, a control method for a printing apparatus, comprising:

a first holding step of causing first holding means to hold first setting data indicating whether or not to print a blank page;

a second holding step of causing second holding means to hold second setting data indicating whether or not to output an interleave page; and a printing step of printing out a page to be printed and an interleave page in accordance with the setting data held by in the first holding step and second holding step, wherein in the printing step, when a setting made by the first setting data indicates inhibition of printing of a blank page and a setting made by the second setting data indicates that an interleave page is to be output, if both a page to be printed and an interleave page to be output before or after the page to be printed are blank pages, the page to be printed and the interleave page are not printed out.

In order to achieve an object of the present invention, for example, a control method for an information processing apparatus of the present invention comprises the following arrangement.

That is, a control method for an information processing apparatus, comprising:

a first holding step of causing first holding means to hold first setting data indicating whether or not to print a blank page;

a second holding step of causing second holding means to hold second setting data indicating whether or not to output an interleave page; and a control step of controlling output of a page to be printed and an interleave page to a printing apparatus in accordance with the setting data held by the first holding means and second holding means, wherein in the control step, when a setting made by the first setting data indicates inhibition of printing of a blank page and a setting made by the second setting data indicates that an interleave page is to be output, if both a page to be printed and an interleave page to be output before or after the page to be printed are blank pages, the page to be printed and the interleave page are not output to the printing apparatus.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in detail in accordance with the accompanying drawings.

First Embodiment

Figure 1:
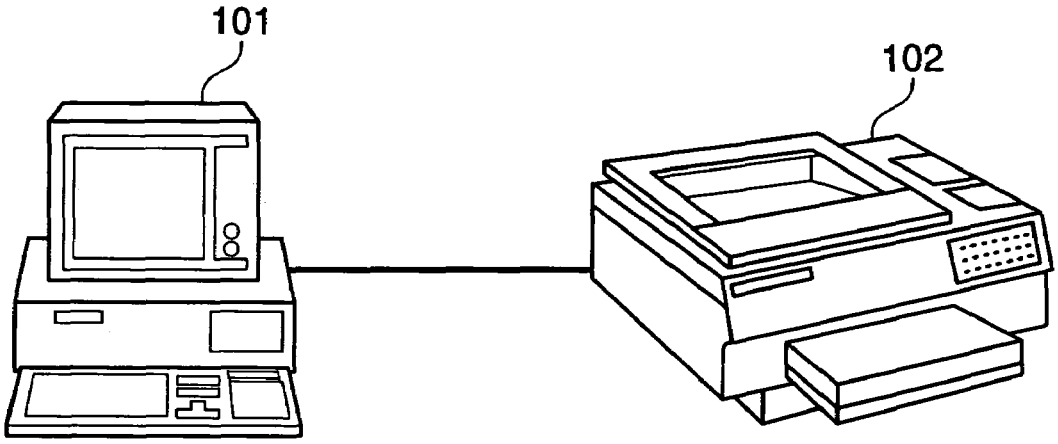
FIG. 1 is a perspective view showing the outer appearance of a printing system comprising a printing apparatus according to the first embodiment of the present invention and a computer which transmits print data to the printing apparatus.

FIG. 1 is a perspective view showing the outer appearance of a printing system comprising a printing apparatus according to this embodiment and a computer which transmits print data to the printing apparatus. Referring to FIG. 1, reference numeral 101 denotes a computer; and 102, a printing apparatus according to the embodiment. The computer 101 transmits print data to the printing apparatus 102. The printing apparatus 102 forms an image or character on a printing medium such as paper or an OHP on the basis of the print data. As the printing apparatus 102, one of apparatuses based on various types of printing schemes, e.g., an inkjet printer and laser beam printer, can be used. In this embodiment, a laser beam printer (to be referred to as an LBP hereinafter) is used. Obviously, however, the present invention is not limited to this.

The printing operation performed by this printing apparatus will be described below.

Figure 2:
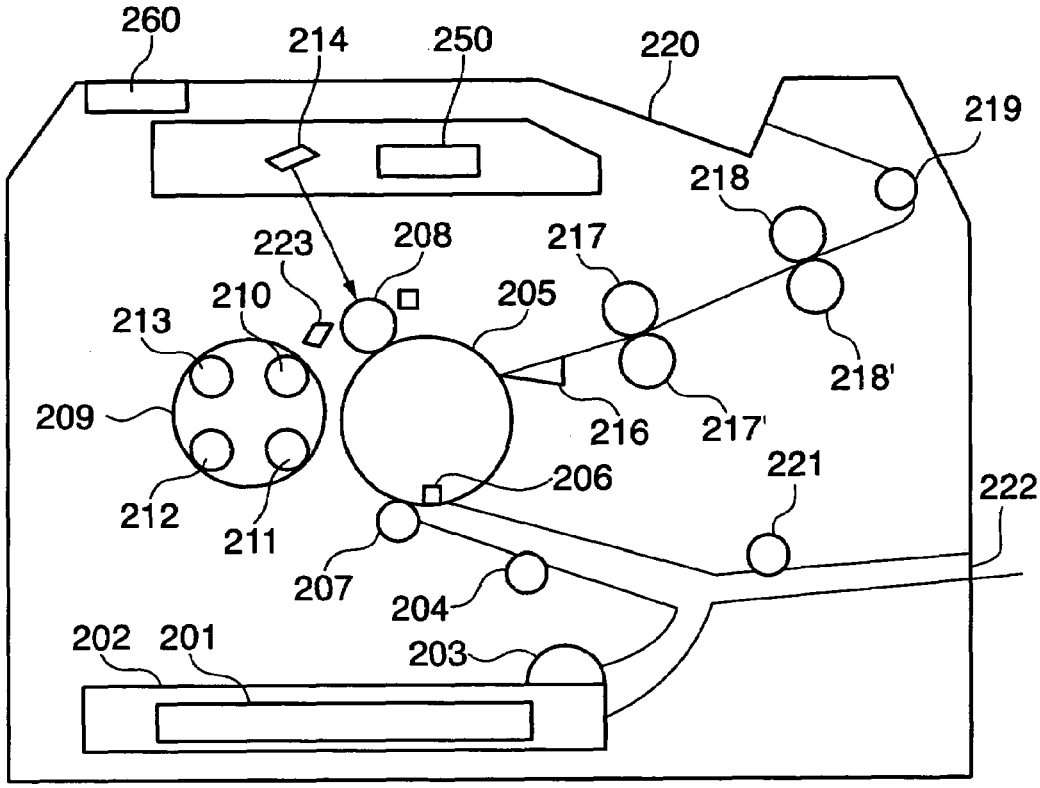
FIG. 2 is a sectional view showing the basic arrangement of the printing apparatus according to the first embodiment of the present invention.

FIG. 2 is a sectional view showing the basic arrangement of the printing apparatus according to this embodiment.

Referring to FIG. 2, reference numeral 201 denotes a paper sheet as a recording medium; 202, a paper cassette which holds the paper sheet 201; and 203, a cassette paper feed clutch which separates only the uppermost paper sheet of the paper sheets 201 placed on the paper cassette 202. The cassette paper feed clutch 203 has a cam shape, which rotates every time paper feed is performed by a driving means (not shown), thereby conveying the leading end portion of the paper sheet to the position of a feed roller 204 upon this separation of the paper sheet. The cassette paper feed clutch 203 feeds one paper sheet per rotation. When the paper sheet is conveyed by the cassette paper feed clutch 203, the feed roller 204 conveys the paper sheet 201 while rotating and lightly pressing the paper sheet 201.

Reference numeral 222 denotes a paper tray; and 221, a manual paper feed clutch. This arrangement makes it possible to manually feed paper sheets one by one from the paper tray 222 in addition to the above paper feed from the paper cassette 202.

Reference numeral 205 denotes a transfer drum; 206, a gripper which grips the leading end of a paper sheet; and 207, a convey roller. In printing operation, the transfer drum 205 rotates at a predetermined speed, and when the gripper 206 on the transfer drum 205 comes to the position of the leading end of a paper sheet, the gripper grips the leading end portion of the paper sheet. As the convey roller 207 rotates, the paper sheet 201 is wound around the transfer drum 205 and is further conveyed.

Reference numeral 208 denotes a photosensitive drum; 209, a developing device support unit; 210, a yellow (Y) toner developing device; 211, a magenta (M) toner developing device; 212, a cyan (C) toner developing device; and 213, a black (BK) toner developing device. As the developing device support unit 209 rotates, it conveys a desired color toner developing device to a position on the photosensitive drum 208 at which developing can be done.

Reference numeral 214 denotes a laser driver. The laser driver 214 scans on the photosensitive drum 208 in the main scanning line direction to form a latent image on the main scanning lines while turning on/off a semiconductor laser (not shown) in accordance with the dot data sent out from a controller unit 250. The photosensitive drum 208 is rotated/driven so as to synchronize this latent image formation with a position on the paper sheet 201 on the transfer drum 205. That is, a 1-page latent image is formed on the surface of the photosensitive drum 208, which is charged by a charger (not shown), by exposure using the above laser beam. The latent image on the photosensitive drum 208 is developed as a toner image by a predetermined color toner developing device of the developing devices 210, 211, 212, and 213. The toner image is then transferred onto the paper sheet 201 on the transfer drum 205.

Operation similar to the above operation is repeated the number of times equal to the number of color toners required, thereby superimposing toner images on the paper sheet 201 on the transfer drum 205. The paper sheet 201 onto which the required toner images are transferred is separated from the transfer drum 205 by a transfer separation pawl 216. The toner images are heated and fixed by a pair of fixing rollers 217 and 217'. The paper sheet 201 is then delivered onto a delivery tray 220 through convey rollers 218, 218', and 219.

Reference numeral 223 denotes a density sensor which detects the density of each of toner images as Y, M, C, and K patches which is formed on the photosensitive drum 208 at a predetermined timing.

Reference numeral 250 denotes a controller unit which controls the overall printing apparatus 102; and 260, an operation unit which includes a display unit for displaying the number of paper sheets to be printed, the size of a printing paper sheet, various kinds of settings, and the like, operation buttons, and the like.

Figure 5:
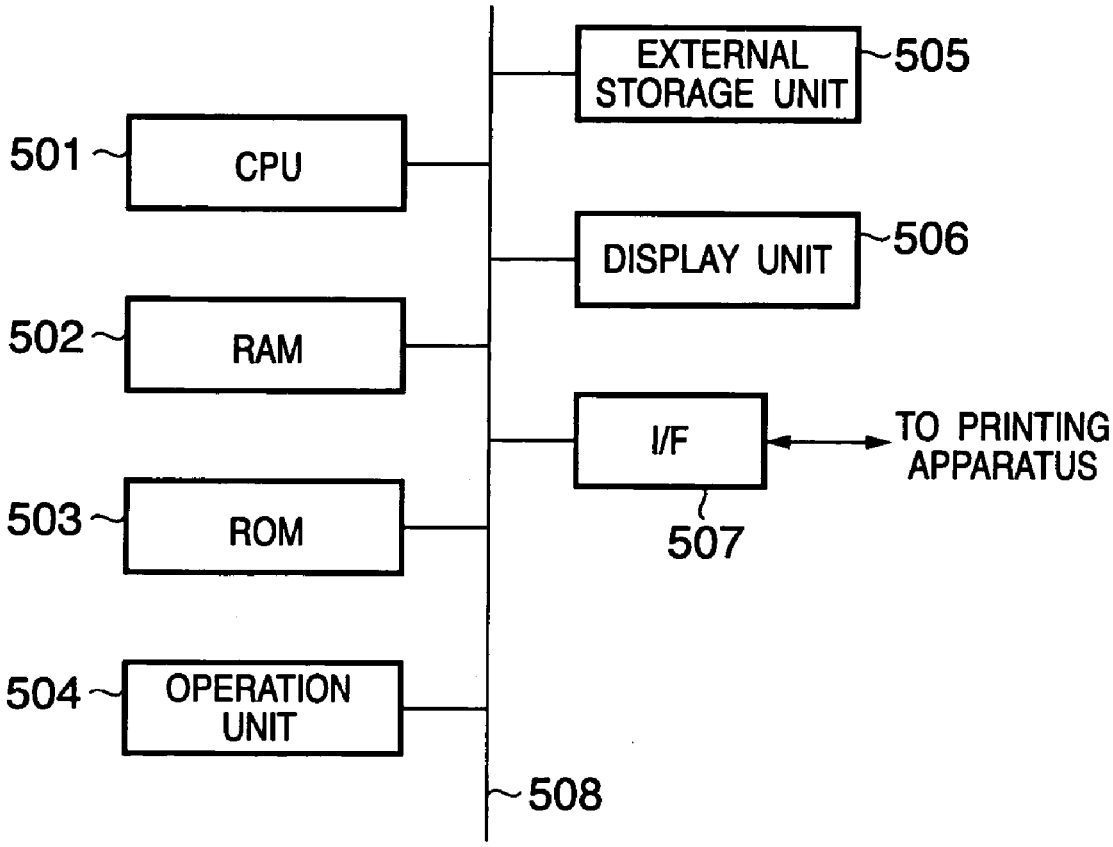
FIG. 5 is a block diagram showing the basic arrangement of the computer 101.

FIG. 5 is a block diagram showing the basic arrangement of the computer 101.

Reference numeral 501 denotes a CPU which controls the overall computer 101 by using programs and data stored in a RAM 502 and ROM 503, and executes each processing (to be described later) which is to be performed by the computer 101.

The RAM 502 includes an area for temporarily storing the program or data loaded from an external storage unit 505, and a work area which is used by the CPU 501 to execute various kinds of processes.

The ROM 503 stores a boot program, set data, and the like.

Reference numeral 504 denotes an operation unit which comprises information input devices such as a keyboard, mouse, and the like, and can input various kinds of instructions to the CPU 501.

The external storage unit 505 is a large-capacity information storage unit such as a hard disk drive unit, in which programs and data which are used to make an OS (Operating System) and the CPU 501 execute processes (to be described later) to be executed by the computer 101, programs and data for various kinds of application software to be described later, and various kinds of data generated by the application software can be stored. These programs and data are loaded into the RAM 502 under the control of the CPU 501.

Reference numeral 506 denotes a display unit which comprises a CRT, a liquid crystal screen, or the like, and can display the processing result obtained by the CPU 501 by using images, characters, and the like.

Reference numeral 507 denotes an I/F (interface) which functions as an interface for performing data communication with the printing apparatus 102 by wire or wirelessly. The computer 101 performs data communication with the printing apparatus 102 through the I/F 507.

Reference numeral 508 denotes a bus which connects the respective units described above to each other.

Figure 3:
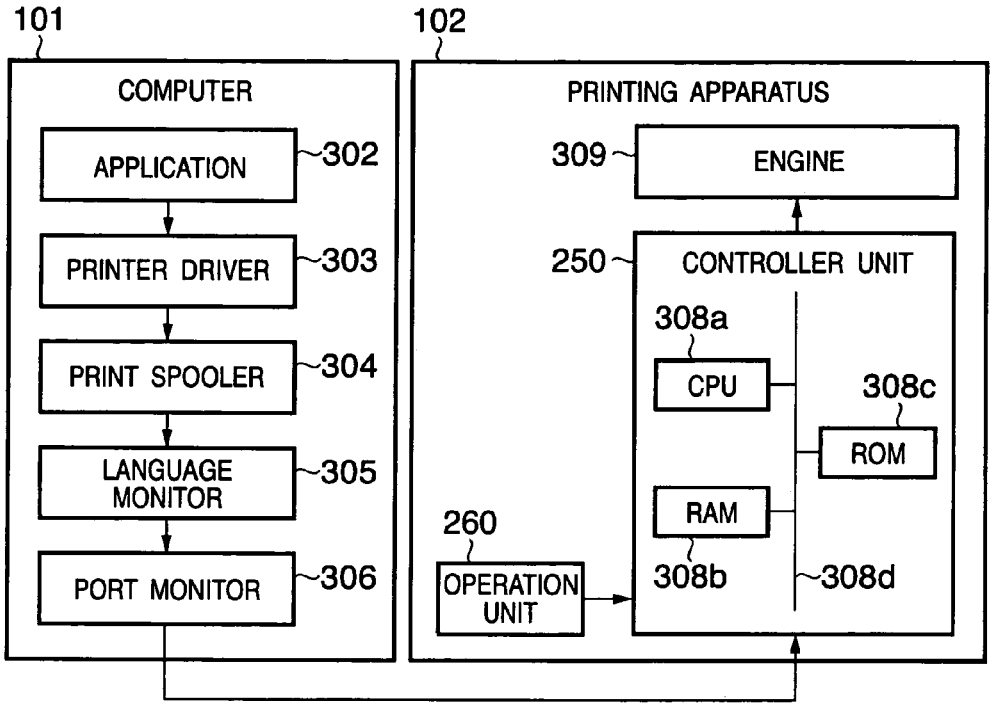
FIG. 3 is a block diagram showing the functional arrangements of a computer 101 and printing apparatus 102.

FIG. 3 is a block diagram showing the functional arrangements of the computer 101 and printing apparatus 102.

The computer 101 holds an application 302, driver 303, spooler 304, language monitor 305, and port monitor 306. In practice, they are stored in the external storage unit 505 in the form of software programs, and are loaded into the RAM 502 as needed to be executed by the CPU 501. This makes it possible to implement the functions of the respective units.

Referring to FIG. 3, the application 302 serves to generate a document to be printed and the like. The generated document or image data is a target for printing to be described later. When the operator of the computer 101 inputs a print instruction by using the operation unit 504, the CPU 501 sends out the document or image data generated by using the application 302 to the printer driver 303 on the subsequent stage. Obviously, the printer driver 303 corresponds to the printing apparatus 102.

The driver 303 generates a print job by compiling print data and print control data on the basis of the document or image data received from the application 302, and sends out the job to the spooler 304.

The spooler 304 manages sent print jobs and sequentially sends them to the language monitor 305.

The language monitor 305 manages print jobs on a page basis, and transfers print data and control data to the port monitor 306.

The port monitor 306 manages device IDs and printers which use the port, and transfers the data, sent from the language monitor 305, to a designated printer (the printing apparatus 102 in this embodiment).

The printing apparatus 102 comprises the controller unit 250, an engine 309, and the operation unit 260. The controller unit 250 comprises a CPU 308*a* which controls the overall printing apparatus 102, a RAM 308*b* for temporarily storing data, a ROM 308*c* which stores programs and data associated with the basic operation of the printing apparatus 102, and a bus 308*d* which connects the respective units to each other.

The CPU 308*a* of the controller unit 250 performs processing for sending out print data, sent out from the port monitor 306 of the computer 101, to the engine 309, print control in accordance with the control data sent out from the port monitor 306, control on the engine 309, and the like.

The operation unit 260 includes operation buttons for various kinds of input operations, as described above. The data of settings input by this unit are stored in the RAM 308*b* of the controller unit 250.

The engine 309 performs printing in accordance with the print data sent from the controller unit 250.

Processing for making the printing apparatus 102 print the document or image generated on the computer 101 side will be described next.

Figure 4:
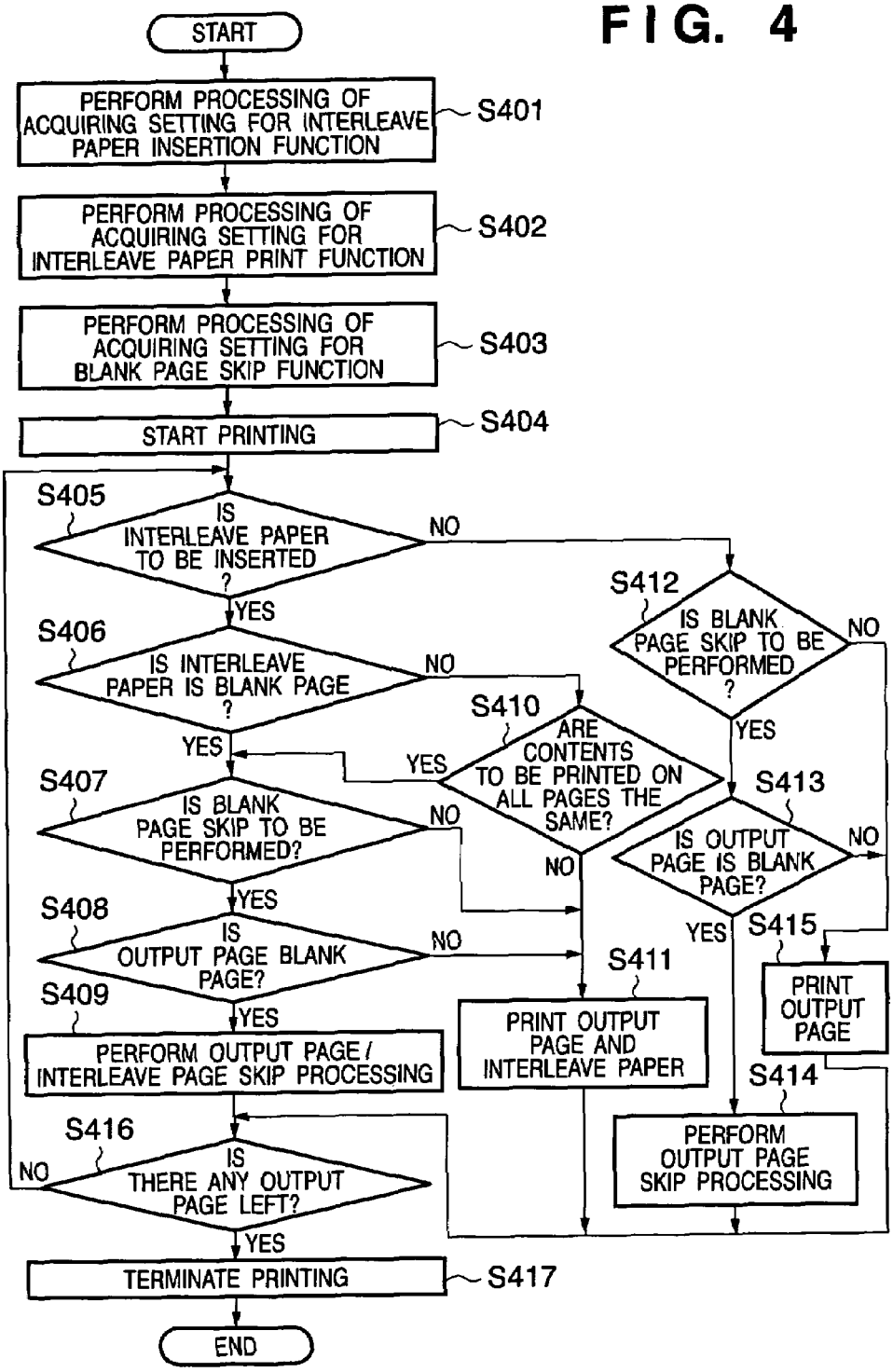
FIG. 4 is a flowchart for print control processing executed to make the printing apparatus 102 perform printing by causing a CPU 501 of the computer 101 to execute software for a language monitor 305.

FIG. 4 is a flowchart for print control processing to be performed to make the printing apparatus 102 perform printing by causing the CPU 501 of the computer 101 to execute the software for the language monitor 305. The program based on the flowchart of FIG. 4 is stored in the external storage unit 565. This program is loaded into the RAM 502 under the control of the CPU 501. The CPU 501 then executes the program to perform processing in accordance with the flowchart of FIG. 4.

Before the execution of processing in accordance with the flowchart of FIG. 4, the operator of the computer 101 generates a document or image data by using the application 302. The operator then uses the operation unit 504 to input a print instruction for the generated document or image data. When inputting the print instruction, the user also makes various print settings.

Upon receiving this print instruction, the CPU 501 of the computer 101 sends out the generated document or image data to the printer driver 303, together with data (print control data) for print control, e.g., print settings.

When the CPU 501 executes the printer driver 303, print data suitable for the printing apparatus 102 is generated from the received document or image data. A print job including the generated print data and print control data is then sent out to the language monitor 305 through the print spooler 304.

When the CPU 501 executes the language monitor 305, various kinds of processing (to be described below) are executed.

First of all, the CPU 501 reads setting data indicating whether or not to insert interleave paper between print pages from the various kinds of setting data contained in the print control data, and stores the read data in the RAM 502 (step S401). The CPU 501 also reads data indicating whether or not to also print on each interleave paper from the various kinds of setting data contained in the print control data, and if the interleave paper is printed, reads data indicating whether or not the same contents are printed on all pages. The CPU 501 then stores the read data in the RAM 502 (step S402).

If there is a blank page, the CPU 501 reads setting data indicating whether or not to print it from the various kinds of setting data contained in the printing control data, and stores the read data in the RAM 502 (step S403).

As described above, as to whether or not to insert interleave paper between print pages, setting is made before a print instruction is issued by using the application 302. Therefore, setting data indicating whether or not to insert interleave paper between print pages is data generated on the basis of this setting.

Assume that when printing is performed on interleave paper, the data of corresponding setting contents is contained in the above print data.

Likewise, as described above, if there is a blank page, setting as to whether or not to print it is made before a print instruction is issued by using the application 302. If, therefore, there is a blank page, setting data indicating whether or not to print it is data generated on the basis of this setting.

Referring back to FIG. 4, various kinds of initial settings associated with printing are made (step S404). The processing in step S405 and the subsequent steps is then performed. The processing in steps S405 to S416 is performed on a page basis.

In step S401, the CPU 501 refers to "setting data indicating whether or not to insert interleave paper between print pages" stored in the RAM 502, and determines whether or not to insert interleave paper after printing a page to be printed (step S405).

When interleave paper is to be inserted, the flow advances to step S406 to refer to "data indicating whether or not to also print on interleave paper" stored in the RAM 502 in step S402 and determine whether or not to print on the interleave paper after printing a page to be printed, i.e., whether or not to print out the interleave paper as a blank page (step S406).

If the interleave paper is to be printed out as a blank page, the flow advances to step S407 to refer to "setting data indicating, if there is a blank page, whether or not to print it" stored in the RAM 502 in step S403 and determine, if there is a blank page, whether or not to print it (step S407).

If it is determined in step S406 that the interleave paper is not printed out as a blank page, the flow advances to step S410 to refer to "data indicating whether or not the same contents are to be printed on all interleave paper sheets" stored in the RAM 502 and determine whether or not to print the same contents on the respective interleave paper sheets. If the same contents are to be printed on the respective interleave paper sheets, the flow advances to step S407.

If it is determined in step S407 that setting has been made not to print a blank page, if it is present, i.e., the blank page skip function has been set, the flow advances to step S408 to refer to print data and determine whether or not the page to be printed is a blank page (step S408).

If the page to be printed is a blank page, the flow advances to step S409, in which the language monitor 305 inhibits the print data of the page to be printed from being sent out to the port monitor 306, and cancels a print instruction for the interleave paper scheduled to be printed subsequently, thereby canceling printing on the page to be printed and on the interleave paper scheduled to be printed subsequently, i.e., performing blank page skip (step S409).

The flow then advances to step S416 to check whether or not any page to be printed is left (step S416). If no page is left, since it indicates the end of printing, post-processing, e.g., displaying a message indicating the end of printing on the display screen of the display unit 506, is performed (step S417).

In either of the following cases: it is determined in step S410 that the same contents are not printed on the respective interleave paper sheets; it is determined in step S407 that if there is a blank page, the page is printed; and it is determined in step S408 that the page to be printed is not a blank page, the flow advances to step S411 to output, to the port monitor 306, the print data of the page to be printed and the print data of the interleave paper scheduled to be printed subsequently (step S411). This allows the printing apparatus 102 to perform printing on the page to be printed and the interleave paper scheduled to be printed subsequently.

If it is determined in step S405 that no interleave paper is inserted after the page to be printed is printed, the flow advances to step S412 to determine, as in step S407, whether or not the blank page skip function is set (step S412). If it is determined in step S412 that the blank page skip function is set, the flow advances to step S413 to determine, as in step S408, whether or not the page to be printed is a blank page (step S413).

If the page to be printed is a blank page, the flow advances to step S414, in which the language monitor 305 inhibits the print data of the page to be printed from being sent out to the port monitor 306, thereby canceling printing of the page to be printed, i.e., performing blank page skip (step S414).

In either of the following cases: it is determined in step S412 that the blank page skip function is not set; and it is determined in step S413 that the page to be printed is not a blank page, the flow advances to step S415 to output the print data of the page to be printed to the port monitor 306 (step S415). This allows the printing apparatus 102 to print the page to be printed.

As described above, according to this embodiment, when setting for blank page skip and setting for the insertion of interleave paper are made, if a printout is a blank page and the subsequent interleave paper is a blank page or the contents to be printed on all pages are the same, blank page skip can be performed with respect to the printout and interleave paper. This makes it possible to suppress wasteful paper outputs.

Second Embodiment

In the first embodiment, the processing based on the flowchart of FIG. 4 is performed by causing the CPU 501 to execute the program of software for the language monitor 305. In contrast to this, in the second embodiment, the processing based on the flowchart of FIG. 4 is executed by a controller unit 250 of a printing apparatus 102. Therefore, the processing contents in each step are substantially the same as in the first embodiment, but the hardware used in the processing in each step differs from that in the first embodiment.

The program based on the flowchart of FIG. 4 is stored in a ROM 308c of the controller unit 250. The processing based on the flowchart of FIG. 4 can be performed by causing a CPU 308*a* to execute the program.

This processing is started when the controller unit 250 receives print data and print control data transferred from a port monitor 306.

The processing described below is performed by the CPU 308*a* of the controller unit 250.

First of all, the CPU 308*a* reads setting data indicating whether or not to insert interleave paper between print pages from the various kinds of setting data contained in the print control data, and stores the read data in the RAM 308*b* in the controller unit 250 (step S401). The CPU 308*a* also reads data indicating whether or not to also print on each interleave paper from the various kinds of setting data contained in the print control data, and if the interleave paper is printed, reads data indicating whether or not the same contents are to be printed on all pages. The CPU 308*a* then stores the read data in the RAM 308*b* (step S402).

If there is a blank page, the CPU 308*a* reads setting data indicating whether or not to print it from the various kinds of setting data contained in the printing control data, and stores the read data in the RAM 308*b* (step S403).

Subsequently, various kinds of initial settings associated with printing are made (step S404). The processing in step S405 and the subsequent steps is then performed. The processing in steps S405 to S416 is performed on a page basis.

The CPU 308*a* refers to "setting data indicating whether or not to insert interleave paper between print pages" stored in the RAM 308*b* in step S401, and determines whether or not to insert interleave paper after a printing page to be printed (step S405).

When interleave paper is to be inserted, the flow advances to step S406 to refer to "data indicating whether or not to also print on interleave paper" stored in the RAM 308*b* in step S402 and determine whether or not to print on the interleave paper after printing a page to be printed, i.e., whether or not to print out the interleave paper as a blank page (step S406).

If the interleave paper is to be printed out as a blank page, the flow advances to step S407 to refer to "setting data indicating, if there is a blank page, whether or not to print it" stored in the RAM 308*b* in step S403 and determine, if there is a blank page, whether or not to print it (step S407).

If it is determined in step S406 that the interleave paper is not printed out as a blank page, the flow advances to step S410 to refer to "data indicating whether or not the same contents are to be printed on all interleave paper sheets" stored in the RAM 308*b* in step S403 and determine whether or not to print the same contents on the respective interleave paper sheets. If the same contents are to be printed on the respective interleave paper sheets, the flow advances to step S407.

If it is determined in step S407 that setting has been made to inhibit printing of a blank page, if it is present, i.e., the blank page skip function has been set, the flow advances to step S408 to refer to print data and determine whether or not the page to be printed is a blank page (step S408).

If the page to be printed is a blank page, the flow advances to step S409, in which the CPU 308*a* of the controller unit 250 inhibits the print data of the page to be printed from being sent out to an engine 309, and cancels a print instruction for the interleave paper scheduled to be printed, thereby canceling printing on the page to be printed and on the interleave paper scheduled to be printed subsequently, i.e., performing blank page skip (step S409).

The flow then advances to step S416 to check whether or not a print end instruction has been received from a computer 101 (i.e., any page to be printed is not left) (step S416). If no page is left, since it indicates the end of printing, the printing is terminated, and post-processing, e.g., transmitting, to the computer 101, information indicating that the printing apparatus 102 is in the standby state, is performed (step S417).

In either of the following cases: it is determined in step S410 that the same contents are not to be printed on the respective interleave paper sheets; it is determined in step S407 that if there is a blank page, the page is printed; and it is determined in step S408 that the page to be printed is not a blank page, the flow advances to step S411 to output, to the engine 309, the print data of the page to be printed and the print data of the interleave paper scheduled to be printed subsequently (step S411). This makes it possible to perform printing on the page to be printed and the interleave paper scheduled to be printed subsequently.

If it is determined in step S405 that no interleave paper is inserted after the page to be printed is printed, the flow advances to step S412 to determine, as in step S407, whether or not the blank page skip function is set (step S412). If it is determined in step S412 that the blank page skip function is set, the flow advances to step S413 to determine, as in step S408, whether or not the page to be printed is a blank page (step S413).

If the page to be printed is a blank page, the flow advances to step S414 to inhibit the print data of the page to be printed from being sent out to the engine 309, thereby canceling printing of the page to be printed, i.e., performing blank page skip (step S414).

In either of the following cases: it is determined in step S412 that the blank page skip function is not set; and it is determined in step S413 that the page to be printed is not a blank page, the flow advances to step S415 to output the print data of the page to be printed to the engine 309 (step S415). This makes it possible to print the page to be printed.

As described above, as in the first and second embodiments, when blank page skip is to be performed, if an output page is a blank page and the subsequent interleave paper is a blank page or the contents to be printed on all interleave paper sheets are the same, the same effects can be obtained by causing either the computer 101 or the printing apparatus 102 to perform processing of inhibiting the output page and the subsequent interleave paper from being output. That is, even with the setting for interleave paper insertion, blank page skip can be realized.

Note that the operation unit 260 of the printing apparatus 102 may make settings for determination whether or not to insert interleave paper between print pages and, if there is a blank page, for determination whether or not to print it.

Other Embodiment

Obviously, the object of the present invention is realized even by causing the CPU or MPU of a camera to read out and execute software program codes from a recording medium (or storage medium) on which software program codes for implementing the functions of the above embodiments are stored. In this case, the program codes read out from the recording medium realize the functions of the above embodiments by themselves, and the recording medium on which the program codes are recorded constitutes the present invention.

Obviously, the functions of the above embodiments are realized not only when the program codes read out by the camera are executed but also when the OS (Operating System) running on the camera performs part or all of actual processing on the basis of the instructions of the program codes.

Obviously, the functions of the above embodiments are also realized when the program codes read out from the recording medium are written in the memory of a function expansion board inserted into the camera or a function expansion unit connected to the camera, and the CPU of the function expansion board or function expansion unit performs part or all of actual processing on the basis of the instructions of the program codes.

When the present invention is to be applied to the above recording medium, program codes corresponding to the flowchart (functional arrangement) described above are stored in the recording medium.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-175996 filed on Jun. 14, 2004, the entire contents of which are hereby incorporated by reference herein.

What is claimed is:

1. An information processing apparatus capable of outputting pages to be printed to a print device, comprising:

an interleave page determination unit which determines whether or not to output an interleave page before or after a print target page;

a determination unit which, when said interleave page determination unit determines to output the interleave page before or after the print target page, determines whether or not identical contents are printed on all the interleave pages;

a blank page output determination unit which determines whether or not to permit outputting a blank page;

an output unit which outputs the print target page and the interleave page to the print device, without executing determination by said blank page output determination unit, when said determination unit determines that identical contents are not printed on all the interleave pages to be outputted; and a control unit which controls said output unit to prevent outputting both the print target page and the interleave page if the print target page is the blank page even if the interleave page is not the blank page, when said determination unit determines that identical contents are printed on all the interleave pages to be outputted and said blank page output determination unit determines that the blank page is not permitted outputting.

2. A method for an information processing apparatus capable of outputting pages to be printed to a print device, comprising:

an interleave page determining step which determines whether or not to output an interleave page before or after a print target page;

a determining step which, when said interleave page determining step determines to output the interleave page before or after the print target page, determines whether or not identical contents are to be printed on all the interleave pages;

a blank page output determining step which determines whether or not to permit outputting a blank page;

an output step which outputs the print target page and the interleave page to the print device, without executing determination by said blank page output determining step, when said determining step determines that the identical contents are not printed on all the interleave pages to be outputted; and a control step which controls said output step to prevent outputting both the print target page and the interleave page if the print target page is the blank page even if the interleave page is not the blank page, when said determining step determines that identical contents are printed on all the interleave pages to be outputted and said blank page output determining step determines that the blank page is not permitted outputting.

* * * * *